United States Patent [19]

Meyer et al.

[11] 4,183,125

[45] Jan. 15, 1980

[54] METHOD OF MAKING AN INSULATOR-SUPPORT FOR LUMINESCENT DISPLAY PANELS AND THE LIKE

[75] Inventors: Ralph L. Meyer, Elgin; Alan Sobel, Evanston, both of Ill.

[73] Assignee: Zenith Radio Corporation, Glenview, Ill.

[21] Appl. No.: 730,113

[22] Filed: Oct. 6, 1976

[51] Int. Cl.[2] ..... H01J 9/02; H01J 9/18

[52] U.S. Cl. ..... 29/25.15; 29/25.13

[58] Field of Search ..... 65/36, 43, 4 R; 156/180–181, 296; 29/25.13, 25.15, 25.16; 316/19

[56] References Cited

U.S. PATENT DOCUMENTS

| | | | |
|---|---|---|---|
| 3,086,576 | 4/1963 | Thaden | 156/180 X |
| 3,565,740 | 2/1971 | Lazar et al. | 156/181 X |
| 3,649,401 | 3/1972 | Gunnerson | 156/180 X |
| 3,717,531 | 2/1973 | Smith | 156/180 |
| 3,755,054 | 8/1973 | Medney | 156/181 X |
| 3,819,442 | 6/1974 | Brushenko | 156/180 |

*Primary Examiner*—Richard B. Lazarus
*Attorney, Agent, or Firm*—John H. Coult

[57] ABSTRACT

This disclosure depicts a method of making an extended-area cellular spacer-support for separating electrodes in a luminescent display panel and/or for providing support against atmospheric pressure on the panel. The method comprises forming a stack of mutually registered open lattices of highly flexible insulative filaments, including tensing the filaments while spacing them such that the stack of filaments defines an array of narrow transverse openings therethrough which serve in the panel as image-element-associated radiation or particle passageways in the stack. The lattices of filaments are then mutually bonded to form a unitary cellular latticework.

14 Claims, 13 Drawing Figures

METHOD OF MAKING AN INSULATOR-SUPPORT FOR LUMINESCENT DISPLAY PANELS AND THE LIKE

CROSS REFERENCE TO RELATED APPLICATION

This application relates to, but is not dependent upon a copening application Ser. No. 730,114 filed Oct. 6, 1976, of common title herewith now U.S. Pat. No. 4,099,082.

BACKGROUND OF THE INVENTION

This invention is directed to a method of making an improved cellular spacer-support structure for luminescent display panels and the like. The invention is known to have utility when used in the manufacture of flat display panels of the gas-discharge type, and especially gas-discharge display panels of the cellular type in which individual display elements, or groups of elements, are formed in discrete cells.

It is conventional in prior art gas-discharge display panels of the cellular type to have an envelope including hermetically sealed front and rear glass slabs. A regular array of gas-discharge cells is established within the envelope at the locations of the intersections of orthogonally arranged row-selection and column-selection electrodes. Gas discharges are selectively established at the intersections of excited pairs of row-selection and column-selection electrodes.

It is common to provide other electrodes for discharge ignition, for current modulation, for scanning the discharge, etc. In certain panels such as disclosed in U.S. Pat. No. 3,845,241, each gas discharge is coupled to a cathodoluminescent stage. Electrons are extracted from the gas discharge and accelerated in the cathodoluminescent stage to excite a phosphor on the inner surface of the viewing window.

The various types of gas-discharge panels, and display panels in general, require one, and in some cases a series, of insulative spacers for separating the various arrays of electrodes within the panel enclosure. It is also common in the prior art to impose on the insulative spacer structure the added function of providing mechanical support against the atmospheric pressure exerted on the extended surfaces of the evacuated panel enclosure. Gas-discharge panels of various types having insulative spacers which appear to also provide structural support are disclosed, for example, in U.S. Pat. Nos. 3,921,021; 3,938,135; 3,798,483; 3,803,439; and 3,753,041.

The constraints imposed upon such insulative spacer-support structures are manifold and challenging. Two obvious requirements are that the structure be electrically insulative and capable of withstanding high compressive forces. Regarding the latter constraint, simple calculations will show that for a flat panel having, for example, a 30-inch diagonal measurement, several tons of atmospheric force are exerted on the face of the panel.

Another requirement imposed upon such spacer-support structures in many panel applications is that the cell passageways by relatively deep, compared to their smallest lateral dimension. For example, the passageways in some applications necessarily must each have a front-to-back depth which is many times its narrowest width dimension.

Further, it is desirable that the passageways be capable of being formed to very small lateral dimensions and be capable of being precisely located in order that high-resolution displays may be made. The spacer-support must be capable of withstanding thermal cycling and other operations to which the panel is subjected during its fabrication and assembly, without intolerable degradation in accuracy of dimensions of the overall structure of the passageways formed therein.

It is very important that the spacer-support structure be capable of manufacture at acceptably low cost. Desirably, the structure should be capable of being easily modified or tailored for added functions or unique applications. In some panel applications, it is desirable that the spacer-support facilitate conditioning of adjacent cells by permitting migration of ions and metastables to adjacent cells to condition them for ready ignition when selected.

Various approaches to fabricating insulative cellular spacer-support structures have been explored. Perhaps the most common method employed for fabricating such structures is by the use of photo-etching techniques. Such an approach is disclosed in such prior art U.S. Pat. Nos. as 3,953,756; 3,789,470; and 3,777,206. One of the problems attending the use of certain etching methods is that the etched material is rapidly "undercut". The implication of this is (see U.S. Pat. No. 3,777,206) that if passageways are to be formed which are relatively deep compared to their lateral dimensions, then such a structure must be built up as a stacked plurality of mutually registered, separately etched layers. Inadequate dimensional accuracy and high cost also plague certain other etching methods.

An alternative approach, disclosed in U.S. Pat. No. 3,885,195 is to use a plurality of parallel glass ribs, shown as being trapezoidal in cross-sectional configuration, which are placed between front and rear slabs of a panel in order to provide the necessary insulation, support and spacing functions.

U.S. Pat. No. 3,953,756 suggests that an insulative spacer-support can be formed by machining a suitable material. U.S. Pat. No. 3,843,427 suggests that a spacer-support structure can be cast. Still another approach is disclosed in U.S. Pat. No. 3,611,019. U.S. Pat. No. 3,611,019 shows a hollow, thin-walled glass box-like structure containing an interwoven single layer mesh of insulative fibers which support the thin walls of the structure. In U.S. Pat. No. 3,611,019, the spacer-support also serves to contain the ionizable gas, excitation of which is achieved through the thin walls of the structure by orthogonally arranged electrodes disposed in contact with the opposite walls of the structure.

None of the prior art spacer-support structures have been found to be completely satisfactory. Most, if not all, have severe limitations in terms of their cost. Most of the prior art approaches are deficient in their ability to produce spacer-support structures having passageways whose individual depth is greater than its smallest lateral dimensions. Certain of these prior art approaches cannot meet the degree of accuracy in placement and configuration of the passageways which is required; other approaches fail when subjected to the severe thermal cycling operations which a panel must undergo during its fabrication. In short, there exists in the art prior to this invention a very strong need for an improved spacer-support structure for luminescent display panels.

This invention is directed to a method of making a spacer-support structure which comprises a stack of mutually registered lattices of filaments adhered together to form a structure defining an array of passageways therein. In this connection, reference is had to U.S. Pat. No. 3,829,734—Schofield. The Schofield patent does not concern the provision of a spacer-support structure or a method of making same, but rather discloses a technique for interweaving a fabric of glass fibers into a mesh of crossed column and row electrodes. The fibers act to space the electrodes and to capture the crossed electrode structure in a unitary fabric. The Schofield patent discloses merely an improvement on an earlier-known technique of interweaving crossed electrodes into a simple mesh (see U.S. Pat. No. 3,602,756—Bonnet), which earlier technique does not employ glass fibers to space the cross electrodes.

OBJECTS OF THE INVENTION

It is a general object of this invention to provide a method of making a cellular spacer-support for a luminescent display panel or the like.

It is a less general object of this invention to provide a method of making such a spacer-support which makes possible fine and precise structuring thereof, thereby permitting the fabrication of high resolution displays.

It is another object to provide a method of making a spacer-support in which cell passageways may be formed whose individual depth is many times its smallest lateral dimension.

It is yet another object to provide a method of making a spacer-support for flat display panels which is relatively inexpensive in its execution and which provides great flexibility in spacer-support fabrication with opportunities for a wide range of auxiliary functions and characteristics to be introduced into the spacer-support.

OTHER PRIOR ART

U.S. Pat. No. 3,808,497—Greeson, Jr.
U.S. Pat. No. 3,790,849—Mayer et al
U.S. Pat. No. 3,896,324—Galves et al
*Industrial Research,* November 1975, page 55.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Whereas the invention is believed to have applicability in a number of fields, it is known to be useful as applied to the fabrication of luminescent display panels, particularly flat display panels of the type wherein the individual image elements, or groups of elements, are formed in cavities or passageways in an insulative spacer-support structure. The spacer-support structure serves to space and electrically insulate electrodes in the panel, and in many cases also provides structural support for the panel against atmospheric loads exerted thereon.

Figure 1:
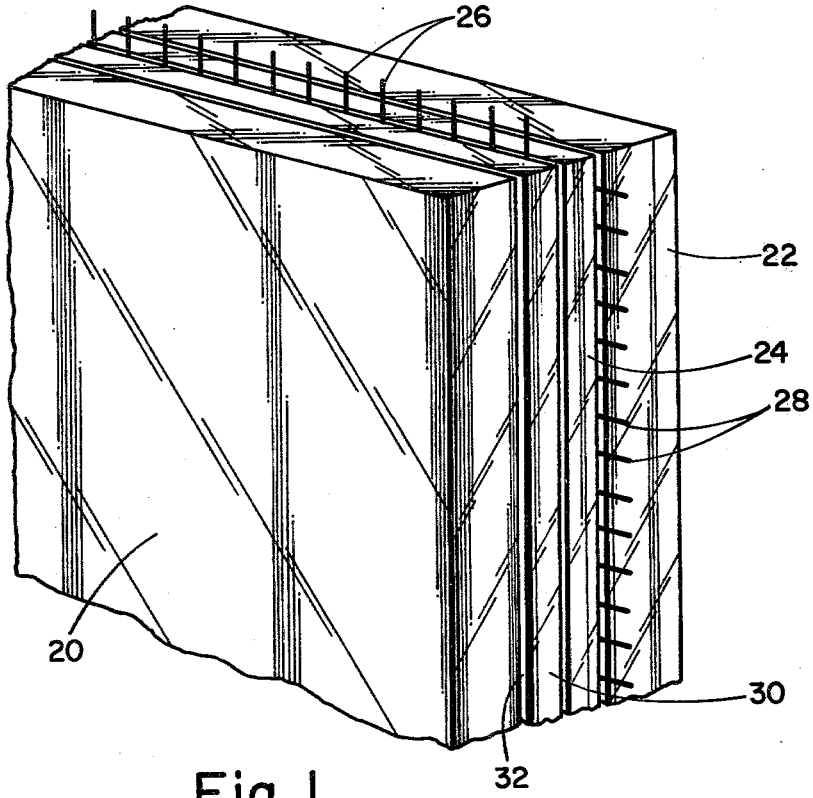
FIG. 1 is a fragmentary, schematic, generalized, perspective view of a luminescent flat display panel.

FIG. 1 schematically illustrates a corner of an evacuated, flat, gas-discharge type luminescent display panel. The FIG. 1 panel is intended to be generalized in character, comprising a viewing window 20 and a rear plate 22, both typically glass slabs. Between the viewing window 20 and the rear plate 22 is an evacuated enclosure within which the luminescent display is formed. Gas discharges associated with particular image elements (or with groups of image elements) are formed in discrete passageways in an insulative spacer-support 24. In order to achieve selective excitation of the matrix of discharges, an array of column electrodes 26 and an orthogonally arranged array of row electrodes 28 are provided, the electrodes 26, 28 being arranged to cross in space at opposite ends of the image-element-associated passageways within which discharges are to be established.

The FIG. 1 panel is shown as including a second spacer-support 30. Between the viewing window 20 and the second spacer-support 30 is a luminescent screen which may include a high-voltage anode 32. The second spacer-support serves to give mechanical support to the panel and also to electrically insulate the column electrodes 26 from the anode 32. The spacer-support 30 may, e.g., have passageways formed therein which comprise part of an electron extraction and acceleration stage. For example, in U.S. Pat. No. 3,845,241 a gas-discharge display panel is illustrated wherein electrons are extracted from a gas discharge and accelerated through passageways in an insulative spacer-support into a high-energy impact with phosphors on the inside surface of a viewing window.

The present invention is directed to a method for making an improved spacer-support structure for use in luminescent display panels and the like. However, before describing the method of the present invention, a number of spacer-supports which follow the teachings of the referent copending application and which may be constructed according to our method will be described.

Figure 2:
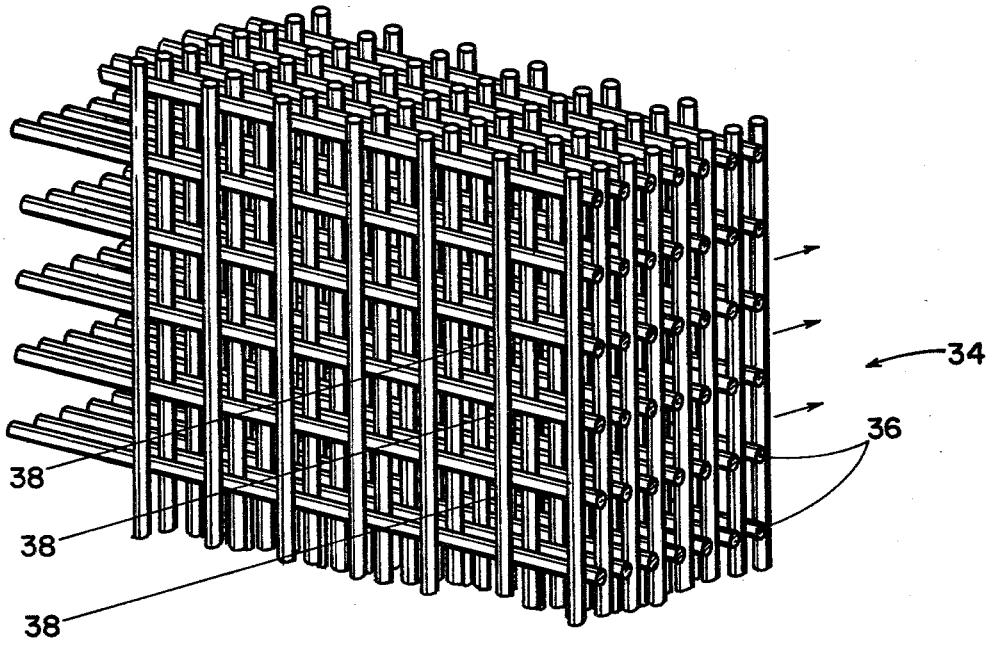
FIG. 2 is an enlarged schematic perspective view of a portion of a novel spacer-support constructed according to the method of the present invention.

FIG. 2 is an enlarged schematic fragmentary view of a cellular spacer-support 34 constructed according to the teachings of the referent copending application. The spacer-support 34 comprises a stack of mutually registered lattices of cross-sectionally stable filaments 36 adhered together to form a latticework defining an array of passageways 38 therein.

As used herein, the term "filaments" is used to mean the individual strands, fibers, threads, strings, canes, rods, or other linear elements which are used as the basic building blocks from which a spacer-support may be constructed according to the present method.

Figure 3:
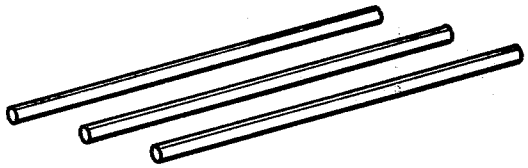
FIGS. 3–8 illustrate various configurations of lattices of filaments from which a spacer-support may be built up according to the method of the present invention.
Figure 4:
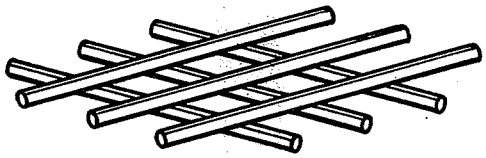
Figure 5:
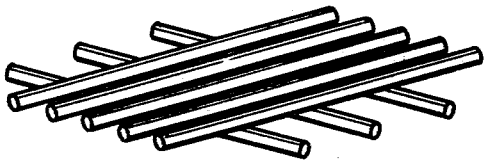
Figure 6:
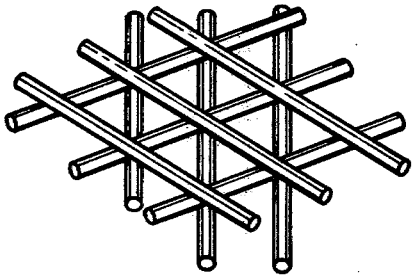
Figure 7:
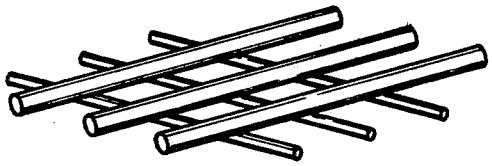
Figure 8:
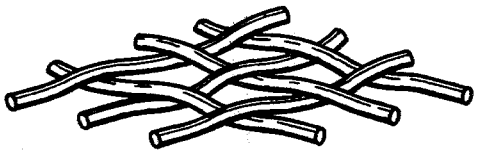

As used herein, the term "lattice" is used in a broad sense to mean one or more layers of filaments arranged and organized as a two-dimensional building block adapted to be stacked to form a spacer-support. For example, FIG. 3 shows a lattice composed of a single layer array of parallel filaments. FIG. 4 illustrates a lattice comprising a pair of crossed arrays of parallel filaments. FIG. 5 shows a lattice like the FIG. 4 lattice, but having the spacing of one array of filaments different from that of the other. FIG. 6 depicts a lattice composed of three layers of parallel filaments arranged at 60° with respect to each other. FIG. 7 shows a lattice in which the filaments which constitute one array are of a different diameter from those of an intersecting array. Alternatively, filaments of different size could be used within the same array to achieve desired spacing or other effects. FIG. 8 illustrates a lattice in which the filaments are not arranged in "log-cabin" style, but rather are interwoven in the warp and weft fashion of a clothing fabric.

As used herein the term "passageway" is intended to mean a channel for passing electrons, ions, metastables and/or electromagnetic rays, depending upon the application, and is meant to encompass not only openings through a spacer-support, but also cavities which are closed at one or both ends.

Turning again to the FIG. 2 structure, the spacer-support 34 is composed of a stack of lattices (preferably dimensionally stable) forming a three-dimensional latticework. In this spacer-support, the "lattice" may be interpreted as being either the single arrays of parallel filaments as shown in FIG. 3, or as pairs of crossed arrays of filaments as shown in FIG. 4. It will become clear that in accordance with the teachings of the present method, a spacer-support could as well be built up as a stack of lattices of many other lattice configurations including those shown in FIGS. 5–8.

Figure 9:
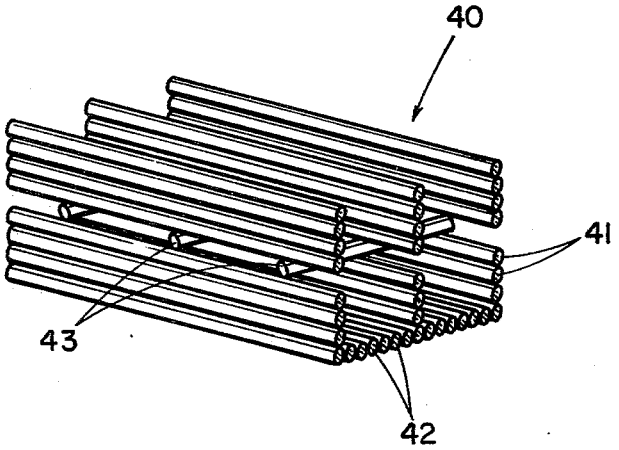
FIG. 9 illustrates another spacer-support which may be constructed following the present invention.
Figure 10:
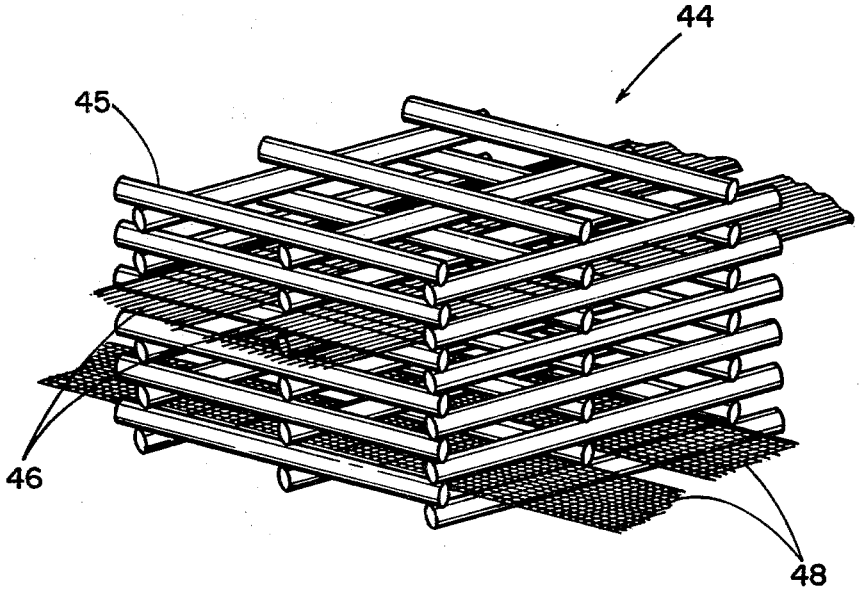
FIG. 10 illustrates a spacer-support made by the method of the present invention wherein electrodes are incorporated in the body of the spacer-support.

FIGS. 9 and 10 illustrate other structures which can be made according to the present method, but before describing these, there will be described a preferred method of making a spacer-support as shown in FIG. 2.

In the majority of applications the spacer-support will act to insulate and space electrodes. In such applications the filaments 36 are electrically insulative and may be composed of a suitable insulative material such as glass. As will be discribed in detail below in a preferred embodiment, the filaments are glass threads or other flexible filaments which are tensed in the desired configuration and then rigidified while in the tensed state. The use of threads which are drawn taut (and therefore straight) makes possible the fabrication of a fine, high-precision structure suitable for use in high-resolution luminescent display panels.

The method according to this invention for making a cellular spacer-support comprises, in general terms, forming a stack of mutually registered lattices of flexible filaments, including tensing the filaments while spacing them such that the stack of lattices defines an array of image-element-associated passageways in the stack. The lattices are then mutually bonded to form a unitary cellular structure. The method will now be described in more detail.

Figure 11:
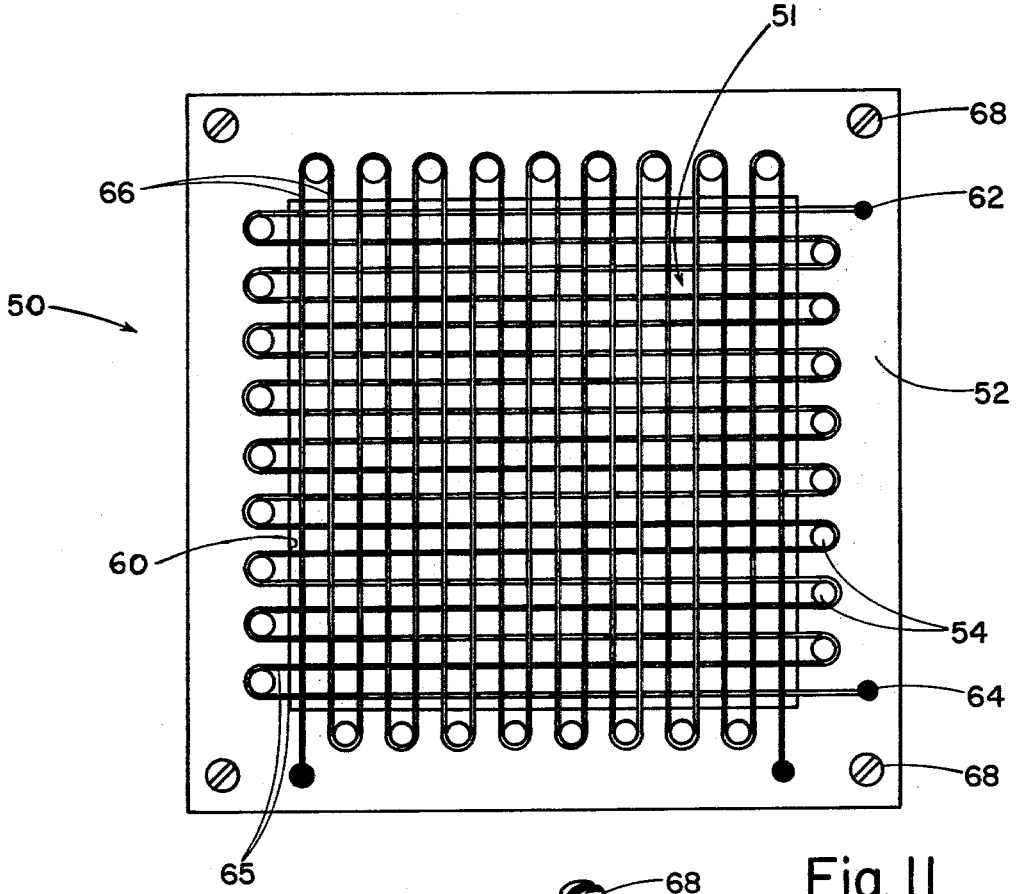
FIGS. 11 and 12 are plan and exploded perspective views of a fixture which may be used in the method of the present invention.
Figure 12:
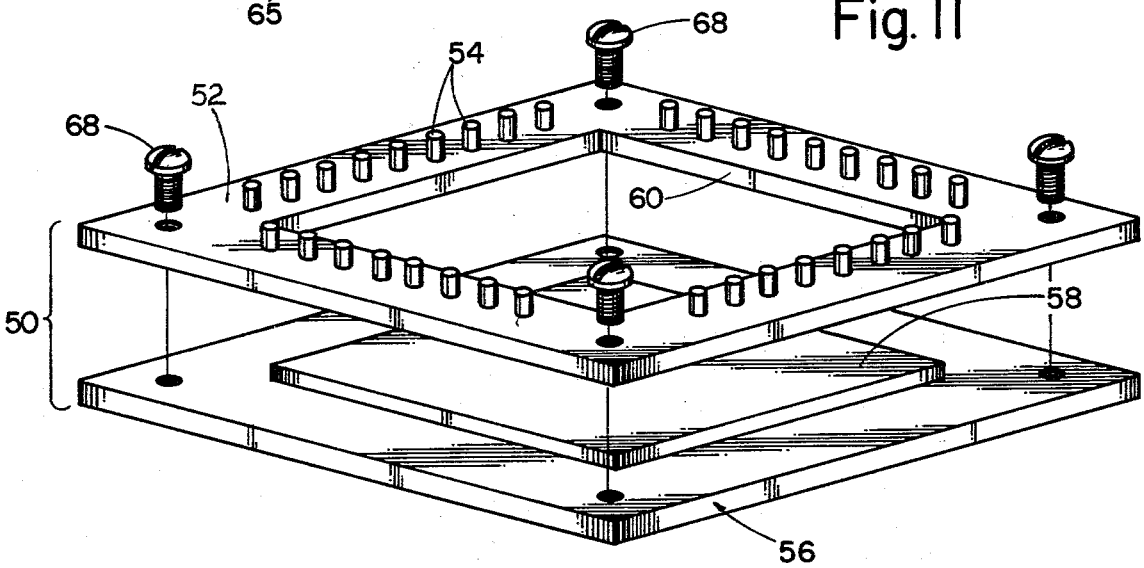

FIG. 11 is a plan view of a fixture 50 useful in the manufacture of a spacer-support according to this invention. FIG. 11 shows a stack 51 of lattices of flexible filaments, preferably glass threads, as they would appear after having been strung on the fixture 50. FIG. 12 is an exploded view of the fixture 50, with the threads removed for clarity of illustration.

The fixture 50 comprises a frame 52 having two orthogonal pairs of opposed, mutually staggered rows of pins 54 on which the filament is strung to form the aforedescribed stack of filament lattices. The frame 52 may be composed of cold-rolled steel. A base plate 56, which may be formed of "jig-plate" type cold-rolled steel, has a plateau 58 in the center which fits closely within the window 60 in the frame 52 when the two fixture components are mated.

To make a spacer-support by the method of this invention, in its preferred execution, a glass thread such as thread No. E12 made by Owens-Corning Fiberglas Corporation having a diameter of 0.010 inch is secured to the frame, as with a fastener 62 which may be a screw, or other suitable instrumentality. The thread is then tightly wound in sinuous fashion back and forth over the staggered pins 54 until a warp of thread 65 is formed. The thread is then cut and adhered to the frame with another fastener 64.

The procedure is then repeated to form an orthogonal second warp of thread 66. Alternatively, the second warp 66 (and succeeding warps) can be wound as an uninterrupted continuation of the first. A stack of like lattices is then built up to form a spacer-support structure of the desired depth. Rather than forming a stack of discrete warps of thread, as shown at 65 and 66, in applications, as here, where all warps or lattices are composed of the same filament, it may be more convenient to wind the warps or lattices in an unbroken succession.

The stack of filaments is then coated with a glass cement, preferably (but not necessarily) a cement which is matched closely in its coefficient of thermal expansion to that of the filaments. By way of example, a suitable cement for use with the said thread is the frit No. 7570 manufactured by Corning Glass Works (non-devitrifying) which has a coefficient of thermal expansion which is approximately the same as that of the aforesaid glass thread. Alternatively, frit No. 7575 (devitrifying) by the same manufacturer may be used.

The stack of lattices may be coated with the cement by spraying the cement in a liquid suspension, as with an air brush or other sprayer which produces a fine mist capable of coating all surfaces in the stack of filaments. To assure a coating uniformity the frame may be rotated while the stack is being sprayed from both sides.

To strengthen the frame and to eliminate any gravity-induced sagging of the filaments during the cement curing process, the frame 52 is then mounted on the baseplate 56 with the plateau 58 closely fitting the window 60 in the frame 52. This may be done after the latticework is strung, but preferably is done before. Screws 68 are used to clamp the frame 52 to the base plate 56. Before mounting the frame 52 on the base plate 56, the base plate is sprayed with a release agent such as graphite.

The fixture is then placed in an oven and baked at a temperature appropriate to cure the frit; in this case a temperature of about 480° C. may be used to cure the suggested Corning frit No. 7570. Once rigidified, the spacer-support becomes a fixed-form lattice work structure capable of withstanding very great compressive loads. By using very fine filaments, a structure can be built up in which the passageways are sufficiently small as to permit construction of a high-resolution display, and yet the individual passageways can be of a depth which is many times the smallest lateral passageway dimension.

By using a fixture of cold-rolled steel or some other material which has a thermal coefficient of expansion significantly greater than that of the glass threads, during the curing operation the fixture will expand to a greater extent than the threads 65, 66, causing the threads to be tensed to an even greater degree than they were when strung upon the frame 52. The frit will cure with the threads in their taut condition, thus assuring that the threads will be straight and accurately positioned as they are rigidified.

After the frit has cured, the fixture is removed from the oven and permitted to cool to room temperature. Due to the differential in coefficient of thermal expansion between the glass threads 65, 66 and the fixture 50, as the fixture cools down, the once-taut, uncoated ends of the thread which surround the pins 54 will relax and permit the resulting spacer-support structure to be easily removed from the fixture. The edges of the spacer-support are then trimmed and the structure is ready for use.

In the FIG. 2 spacer-support, the lattices comprise criss-crossed arrays of filaments of equal spacing such that the spacer-support defines a periodic latticework defining passageways of like size and spacing. The FIG. 2 embodiment is a very useful embodiment in the construction of gas discharge display panels in which each passageway (or a small group of passageways) is associated with a particular image element (or group of elements).

In the FIG. 2 embodiment the filaments are arranged in "log-cabin" fashion, being rigidly joined at their intersections. Depending on the amount of cement that is applied, the filaments may be joined along their full length, in the manner of the "chinking" in a log-cabin. Alternatively, as where it is desired to have ions and/or metastable particles migrate from one cell to adjacent cells through the cell walls, it may be desirable to apply a reduced amount of cement effective to leave openings in the cell walls.

Whereas an application for a structure having nonperiodic arrays of filaments is not envisioned, there is no reason why a spacer-support could not have filaments arranged in a nonperiodic array. Rather than arranging the filaments in a log-cabin fashion, as mentioned above, they can be interwoven in the manner of the FIG. 8 lattice. This would require a loom be used, rather than a fixture of the character shown at 50 in FIGS. 11 and 12. It is believed in fact, that in a mass production implementation of the present method the use of a loom and fabric weaving technique may prove to be the preferred way to carry out the invention.

In the preferred method described above, uncoated highly flexible glass filaments are tensed and arranged to form a stacked array of lattices, the entire structure being rigidified by the application of a cement which is applied to all areas of the latticework and then cured. It is within the compass of this invention to provide variants wherein the structure is not completely rigidified until it is mounted in place during assembly of a luminescent panel. Before being finally assembled, the spacer-support may have some degree of flexibility or pliability.

It is important, however, that the individual filaments which constitute the spacer-support, if not completely rigidified, be bonded at their intersections. Numerous arrangements are possible for effectuating a bonding of the intersecting filaments at their intersections. One propitious approach is to use filaments which are precoated with a cement, preferably a thermo-softenable cement such as a low melting point glass. The use of a cement-clad filament obviates the separate step of applying a cement to the strung latticework to effect a unitization of the stacked lattices. If the cladding is thermo-softenable, the assembled structure need only be heated to a temperature effective to soften the cement and to thus mutually bond the intersecting filaments.

Figure 13:
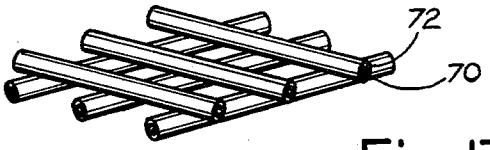
FIG. 13 depicts an aspect of yet another execution of the invention.

A glass fiber having a cladding or cementitious coating is shown in FIG. 13. In FIG. 13 the filament core is designated 70, the cladding 72. The core is preferably composed of a relatively high melting point glass, the outer cladding composed of a relatively lower melting point glass. The filaments are fused to form a unitary structure by baking the assembly at a temperature which will soften the cladding 72, but not the core 70. It is noted that only one set of a crossed set of filaments need be clad. By the use of clad filaments having a cladding of a lower melting point material, the filaments will better retain their alignment and position as they are solidified together than if the filaments were made from a homogeneous material.

Numerous possibilities exist for precoating the filaments or introducing in the filaments as a part of the filament itself a material which will ultimately act to cement or bond the filaments at their intersections. The filaments can be made up of bundles of individual fibers or plies of fibers, which fibers, plies of fibers or bundles of fibers or bundles of plies can be individually and/or collectively clad or cement-coated before being made into a lattice or latticework. Yet another possibility is to intercalate in the latticework itself between the lattices of filaments and in registry therewith, stands of a thermo-softening, cementitious material. Upon heating of the resultant structure, the intercalated strands of cementitious material melt and cause the neighboring filament lattices to fuse together.

In applications wherein the filaments are naked, that is, they do not carry on or in themselves the material which will ultimately act to bond the lattices of filaments together, it should be understood that cements other than glass solder (suggested above), may be employed. Various other cements with the necessary properties are envisioned—for example, potassium silicate or sodium silicate may be used. The important principle or method step regarding cementing of the lattices is that at some point in the spacer-support fabrication process, a cement or other bonding agent is caused to exist at the junctions of the filaments in the filament latticework. As noted, a cement can be introduced as a precoat or cladding on the filaments before they are assembled, or alternatively can be introduced into the latticework after it is formed. Still a third possibility is to introduce the cementitious material on the filaments as they are being strung or woven. As noted above, in addition to the spacer-support structures described above, numerous others can be fabricated employing the teachings of the present method.

Another embodiment is illustrated in FIG. 9. In the FIG. 9 embodiment, the lattice which constitutes the basic building block of the spacer-support 40 is a parallel array of filaments 41, as shown in FIG. 3. By parallel-stacking lattices of such configuration, passageways are formed which are transversely extensive. Such a spacer-support may be useful, for example, in fabricating hollow-cathode structures. Note that the FIG. 9 embodiment also teaches that a row of close-packed filaments can be arranged to define an end wall 42. The FIG. 9 embodiment includes an array of spaced bridge filaments 43 which add lateral support to the stacks of filaments.

FIG. 10 depicts an embodiment which illustrates the versatility provided by the present method. The spacer-support structure 44 is illustrated as being composed of a latticework of orthogonally criss-crossed arrays of filaments 45, as shown in the FIG. 2 embodiment. However, the FIG. 10 embodiment shows that building-block elements other than insulative filaments can be intercalated within, or disposed on the ends of, the filament stack. In the FIG. 10 embodiment, an array of electrodes 46, here shown as being column electrodes such as are depicted schematically at 26 in FIG. 1, is captured in the stack of filaments 45 which makes up the spacer-support structure 44. Another set of electrodes 48, which may for example be the row electrodes 28 in FIG. 1, is intercalated at a different position in the latticework. The separation between the electrodes 46, 48 is determined by the number of lattices of filaments disposed between them.

By the use of a suitable frit or other cement, the electrodes may be fused into the stack to form part of the overall spacer-support structure. It is noted that in applications such as depicted in FIG. 10, it may be desirable to use a devitrifying solder glass to bond the latticework together, except where the electrodes are to be captured, in which places it may be preferable to use a non-devitrifying frit, a cement which can be thermo-softened. The electrodes 46, 48 may be of wire mesh, etched foil, simple single wires, or have any other suitable electrode construction. It will be understood that elements other than, or in addition to, electrodes may also be captured in the stack of filament lattices.

The invention is not limited to the particular details of the method depicted, and other modifications and applications are contemplated. It is clear, for example, that a great variety of spacer-support structures can be made according to the present method merely by varying the pin placement and size parameters and by varying the composition, diameter and other parameters of the thread used to make up the structure. As mentioned above, the filaments can be selected in a variety of sizes and compositions. It is not even necessary that they be of circular cross section. Glass filaments, both clad and unclad, can be drawn in various cross sections with great accuracy and uniformity. Filaments of metal or other electrically conductive material (with or without a cladding or coating of glass or other material) or insulative filaments having a coating of metal, tin oxide, or other suitable electrically conductive material could be used. The filaments need not have a uniform diameter along the length, but could have bulges or bumps to determine the spacing between filaments.

The lattices could be stacked with a progressive lateral off-set, or otherwise constructed or arranged such that the passageways through the latticework are angled or otherwise directed, rather than being normal to the latticework as shown. It is contemplated that the method of the present invention may be implemented on suitably modified commercial looms or, alternatively, on a suitable modification of a machine such as the wirematic (TM) automatic cable-forming system made by Xynetics, Inc. of Santa Clara, Calif. 95051.

What is claimed is:

1. A method of making an extended area cellular spacer-support for separating electrodes in a luminescent display panel and/or for providing support against atmospheric pressure on the panel, comprising:

forming a stack of mutually registered open lattices of highly flexible insulative filaments, including tensing the filaments while spacing them such that the stack of filaments defines an array of narrow transverse openings therethrough which serve in the panel as image-element-associated radiation or particle passageways in the stack; and mutually bonding said lattices of filaments to form a unitary cellular latticework.

2. A method of making an extended area cellular spacer-support for separating electrodes in a luminescent display panel and/or for providing support against atmospheric pressure on the panel, comprising:

forming a stack of mutually registered open lattices of highly flexible insulative filaments, including tensing the filaments while spacing them periodically such that the stack of filaments defines a periodic array of narrow transverse openings therethrough which serve in the panel as image-element-associated radiation or particle passageways in the stack; and rigidifying and mutually bonding said lattices of filaments to form a unitary cellular fixed-form latticework.

3. The method defined by claim 2 wherein said filaments are composed of glass, and wherein said spacer-support is rigidified by applying a coating of cement to said filaments and hardening the cement.

4. The method of claim 2 wherein said method includes introducing in the stack of lattices between individual lattices an electrically conductive electrode, the electrode being permanently captured in the spacer-support during the method step of rigidifying and bonding said lattices of filaments.

5. The method of claim 2 wherein the lateral spacing of the filaents in each lattice and the height of the stack of lattices is such that the depth of the individual passageways in the spacer-support is at least twice the smallest lateral dimension thereof.

6. A method of making an extended area cellular spacer-support for separating electrodes in a luminescent display panel and/or for providing support against atmospheric pressure on the panel, comprising:

forming a stack of mutually registered open lattices of high flexible insulative filaments, including tensing the filaments while spacing them periodically such that the stack of filaments defines a periodic array of narrow transverse openings therethrough which serve in the panel as image-element-associated radiation or particle passageways in the stack, and including intercalating in the stack between said lattices and in registry therewith strands of a thermo-softening cementitious material; and mutually bonding said lattices of filaments to form a unitary cellular latticework by heating said stack of lattices to cause said cementitious strands melt and fuse said lattices of filaments together.

7. The method defined by claim 6 wherein said filaments are composed of a relatively high melting point glass material and wherein said strands of cementitious material are composed of a lower melting point glass material.

8. A method of making a cellular insulative-spacer-support for separating and electrically insulating electrodes in a flat gas discharge display panel and for providing support against atmospheric pressure on the panel, comprising:

on a precision metal fixture, forming a plurality of stacked and mutually registered open lattices of flexible but taut insulative glass filaments having a coefficient of thermal expansion substantially lower than that of the fixture, each lattice comprising a pair of orthogonal warps of periodically spaced filaments, the stacked plurality of lattices defining a periodic, two-dimensionally extending array of narrow transverse openings therethrough which serve in the panel as image-element-associated radiation or particle passageways in the insulator-support;

causing glass solder to exist between filaments in said stack of filaments; and baking the resulting structure to cure the solder and thereby rigidify and mutually bond said lattices of filaments to form a unitary insulative cellular fixed-form structure, the said coefficients of thermal expansion of the filaments and fixture causing the filaments to be tensed during the baking operation and to thus be rigidified in their tensed state.

9. The method defined by claim 8 wherein the lateral spacing of the filaments in each lattice and the height of the stack of lattices is such that the depth of each individual passageway in the spacer-support is at least twice its smallest lateral dimension.

10. The method defined by claim 8 wherein said cement is applied to said filaments after said stack of filaments is formed.

11. The method defined by claim 8 wherein said cement is applied to said filaments as a cladding on at least some of the filaments before they are formed into said stack of filaments.

12. The method defined by claim 8 wherein said filaments are glass threads.

13. The method defined by claim 12 wherein said threads are composed of multiple plies, at least one of which plies comprises one or more strands of a vitreous bonding agent.

14. The method of claim 8 wherein said method includes introducing in the stack of lattices an electrically conductive electrode, the electrode being permanently captured in the spacer-support during the method step of rigidifying and bonding said lattices between individual lattices of filaments.

* * * * *